US010807269B2

(12) United States Patent
Greenleaf

(10) Patent No.: US 10,807,269 B2
(45) Date of Patent: Oct. 20, 2020

(54) FLEXIBLE FINGER BIASING ARRANGEMENT FOR PUNCH PRESS MACHINES

(71) Applicant: Richard J. Greenleaf, Manchester, MA (US)

(72) Inventor: Richard J. Greenleaf, Manchester, MA (US)

( * ) Notice: Subject to any disclaimer, the term of this patent is extended or adjusted under 35 U.S.C. 154(b) by 108 days.

(21) Appl. No.: 16/501,026

(22) Filed: Feb. 11, 2019

(65) Prior Publication Data

US 2019/0176357 A1 Jun. 13, 2019

Related U.S. Application Data

(63) Continuation-in-part of application No. 15/530,236, filed on Dec. 14, 2016, now Pat. No. 10,201,906.

(51) Int. Cl.

| | |
|---|---|
| ***B26D 7/26*** | (2006.01) |
| ***B21D 28/34*** | (2006.01) |
| ***B26F 1/40*** | (2006.01) |
| ***B21D 37/04*** | (2006.01) |

(52) U.S. Cl.

CPC ..... *B26D 7/2628* (2013.01); *B21D 37/04* (2013.01); *B26F 1/40* (2013.01); *B21D 28/34* (2013.01)

(58) Field of Classification Search

CPC ..... Y10T 83/9423; Y10T 83/9476; Y10T 403/5761; B21D 28/34; B26F 1/14; B26D 2007/2607; B26D 7/2628; A47B 91/024

See application file for complete search history.

(56) References Cited

U.S. PATENT DOCUMENTS

| | | | | |
|---|---|---|---|---|
| 245,696 A * | 8/1881 | Black | A47B 91/024 403/309 |
| 288,746 A * | 11/1883 | Vielhaber | F16G 11/04 403/314 |
| 691,448 A * | 1/1902 | Cowell | A47B 91/024 403/309 |
| 2011/0067538 A1* | 3/2011 | Greenleaf | B21D 28/26 83/143 |

* cited by examiner

*Primary Examiner* — Jennifer B Swinney
(74) *Attorney, Agent, or Firm* — Don Halgren

(57) ABSTRACT

A gripping plate assembly for use in a punch press, wherein the gripping plate assembly comprises a planar gripping plate having an upper front side and a lower side, a first bore extending through the gripping plate, for receiving a tool for use in a punch press. A second bore is arranged through the gripping plate having an overlap with the rectilinear groove-cut at the first side of the articulable tab. A threaded bolt is adjustably received in the second bore. The threaded bold has a head with a sloped sidewall for sliding engagement with the sloped first side of the articulable tab so as to provide a displaceable bias thereaginst during rotative advancement or retraction of the threaded bolt within the second bore, thereby effecting a change in the circularity of the wall of the tool receiving first bore.

14 Claims, 4 Drawing Sheets

FLEXIBLE FINGER BIASING ARRANGEMENT FOR PUNCH PRESS MACHINES

The present application for this invention relates to compound tooling punch presses and more specifically to gripping plates for securely holding and aligning die members within that gripping plate, and is a continuation-in-part application of application Ser. No. 15/530,236, filed Dec. 14, 2016, now U.S. Pat. No. 10,201,906, incorporated herein by reference.

BACKGROUND OF THE INVENTION

Discussion of the Prior Art

Compound tooling is currently utilized by hundreds of manufacturers to produce thousands of different types of washers made from aluminum, brass, copper, nylon, steel utilized in almost everything society touches. Washers are for example, utilized in any product with nuts and bolts or moving parts. The inside diameter and the outside diameter of these washers or other punched parts have become more critical and significant for use in the manufacture of high-quality precision devices.

Prior art tool and die sets have to be made slightly loose, and those tools use clamping screws which thus influences a die in a tool holder. That in turn establishes inaccuracies and a loss of concentricity of the alignment of those tools. Recent advances have been improved upon by the present invention which allows adjustment and assembly of multiple gripping arrangements in a single gripping plate.

It is thus an object of the present invention to overcome the disadvantages of the prior art.

It is a further object of the present invention to provide a tool set in which the punch and die members are in exact accurate concentric alignment with one another, and may be adjusted by means accessible from the front face side of the gripping plate, and not from an edge thereof.

It is a further object of the present invention to provide a unique and simple center punch die holder plate arrangement of that tool set in which a tool gripping and alignment plate firmly grips a tool in a biasable irregular opening, which, when biased forms a near-perfect circle for gripping the tool, especially useful in die punching operations for the punching operation, which application is a continuation-in-part application of pending application Ser. No. 15/530,236, filed Dec. 14, 2016, now U.S. Pat. No. 10,201,906, and now incorporated herein by reference.

BRIEF SUMMARY OF THE INVENTION

The present invention comprises a gripping plate arrangement which enables a plurality of flexible finger mechanisms to be arranged on a single gripping plate wherein each flexible finger mechanism is individually adjusted from a front face of the gripping plate.

Each flexible finger mechanism comprises an arcuately extending flexible ribbon-like finger having a first end unitarily connected to, and formed from the gripping plate (aka holder plate or keeper plate), and a second or distal end having a generally rectilinear, articulable tab thereon. The finger has a curvilinear first or inner side which defines about half the circumference of a circular, tool gripping first bore extending through the gripping plate. The finger has a curvilinear second or outer side made from and defined by an arcuate groove-cut through the gripping plate. The arcuate groove-cut through the gripping plate becomes a rectilinear groove-cut at the distal end of the flexible finger to define the outer perimeter of the rectilinear, articulable tab. The rectilinear groove-cut defines three linear sides the articulable tab. The articulable tab has a fourth or curvilinear side facing inwardly to the first bore and defines a further portion of the wall of the circular first bore through the gripping plate. The wall of the first bore at the arcuate groove-cut at the first or proximal end of the finger and a mid-point at the curvilinear side of the articulable tab are 180 degrees apart from one another around the perimeter of the wall of the first bore.

The generally rectilinear articulable tab at the distal end of the curvilinear finger has a first side, a second side and a third side comprising the three linear sides thereof, arranged at right angles with respect to one another, and defined by the groove-cut defining same. The first side of the articulable tab has a sloped surface arranged at an angle of about 3 to 5 degrees with respect to the upper (front face) and lower planar surfaces of the gripping plate.

A second bore is disposed through the gripping plate immediately adjacent the first side of the articulable tab. The second bore has an upper end and a lower end. The lower half or lower end of the second bore is threaded so as to enable adjustable receipt of a finger-adjusting threaded bolt or screw.

A finger-adjusting threaded bolt or screw for use with the present invention would preferably have an Allen Wrench type receiving opening at its upper end. The head of a finger-adjusting bolt or screw would have a head with tapered walls, having a taper of about 3 to 5 degrees with respect to its longitudinal axis, corresponding to the sloped surface of the first side of the articulable tab on the distal end of the flexible finger.

The upper half of the second bore is arranged to overlap with the rectilinear groove-cut at the first side of the articulable tab, so as to enable exposure the tapered head of a finger-adjusting bolt or screw to the groove-cut at the first side of the articulable tab. Advancing a finger-adjustable bolt or screw into the threaded portion in the lower half of the second bore in the gripping plate brings the tapered walls of the finger-adjustable bolt or screw into sliding contact with the sloped first wall of the articulable tab. Such sliding contact between the now longitudinally advancing or withdrawing of the tapered side wall of the head of the finger-adjusting bolt or screw and the sloped first side wall of the articulable tab, biases that tab towards or away from the groove-cut on the third side of the tab (depending upon the direction of rotation of the bolt or screw), thus biasedly adjusting and/or correcting the placement of the fourth (curved) side of the articulable tab with respect to the first bore, and hence the circular shape of the first bore through the gripping plate, enabling proper aligned gripping or release of a tool within the first bore.

The enablement of adjustment to the correctness of circularity of the first bore from the top (front) side of the gripping plate enables a plurality of rows or columns of such flexible finger mechanisms to be disposed within a single plate, avoiding the requirement of making those adjustments from a side edge of the gripping plate, and overcoming the limiting of the number of such flexible finger mechanisms usable in a side-adjustable flexible finger gripping plate, as shown in my U.S. Pat. Nos. 8,925,435, and 10,201,906, both incorporated herein by reference.

The invention thus includes a gripping plate assembly for use in a punch press, the gripping plate assembly comprising: a planar gripping plate having an upper front side and a lower side; a first bore extending through the gripping plate, for receiving a tool for use in a punch press, the first bore defining an inner wall; a semi-annular groove-cut extending half way around the inner wall of the first bore to define an arcuate flexible finger having a proximal end unitary with the gripping plate, and the flexible finger with a distal end having an articulable rectilinearly shaped tab thereon, the articulable tab peripherally defined by a rectilinear groove-cut therearound, and wherein the articulable tab has a sloped first side; a second bore arranged through the gripping plate having an overlap with the rectilinear groove-cut at the first side of the articulable tab; and a threaded bolt adjustably received in the second bore, the threaded bolt having a head with a sloped sidewall for sliding engagement with the sloped first side of the articulable tab so as to provide a displaceable bias thereaginst during rotative advancement or retraction of the threaded bolt within the second bore, thereby effecting a change in the circularity of the wall of the tool receiving first bore.

The slope of the first side of the articulable tab is about 3 to 5 degrees. The flexible finger extends about 180 degrees around the wall of the first bore. The second bore overlaps with the groove-cut around the articulable tab. The first bore groove-cut has an inner side which defines an arcuate outer side of the flexible finger. The articulable tab is biasable against the groove-cut defining its third side. The articulable tab has a fourth side which is curvilinear and corresponds proximally to the wall of the first bore.

The invention also includes a methodic system for gripping and aligning a tool in a punch press utilizing a gripping plate, comprising: arranging gripping mechanism comprising a first tool-engaging circularity-adjustable bore through a front face of a gripping plate, the first tool-engaging bore having a side wall; forming a groove-cut around a semi-circular portion of the side wall of the first bore to form an elongated, arcuately shaped flexible finger having a proximal end integral with the gripping plate, and a distal end with an articulable tab, the articulable tab being defined by a rectilinear groove-cut extending peripherally therearound; arranging a second bore through the front face of the gripping plate, adjacent the first bore, the second bore being in overlapping placement with the groove-cut defining the rectilinear groove-cut which defines the periphery of the articulable tab, the second bore have a threaded lower half for receipt of a articulable tab adjustment threaded bolt; arranging a sloped surface on a first side of the articulable tab; placing a threaded bolt into the second bore; placing a tool into the first bore for alignment in a punch press; and turning the threaded bolt so as to slidably engage the sloped surface on the articulable tab, biasing the articulable tab in a sideways direction to change circularity of the first bore holding the tool therein. The threaded bolt has a head on its upper end, the head having a circumferential wall which is sloped to biasably correspond to the slope of the first side of the articulable tab. The slope on the first side of the articulable tab is preferably about 3 to 5 degrees from normal, with respect to the front face of the gripping plate. The threaded bolt or screw has an open tool-engaging hole or slot at its upper end for receipt of a turning tool via the front face. The system includes forming a plurality of gripping mechanisms into a gripping plate to enable a plurality of tools to be engaged by a single gripping plate.

The invention also includes a gripping plate assembly for use in a punch press, the gripping plate assembly comprising: a planar gripping plate having an upper front side and a lower side; a first bore extending through the gripping plate, for receiving a tool for use in a punch press, the first bore defining an inner wall; a semi-annular groove-cut extending half way around the inner wall of the first bore to define an arcuate flexible finger having a proximal end unitary with the gripping plate, and the flexible finger with a distal end having an articulable rectilinearly shaped tab thereon, the articulable rectilinearly shaped tab peripherally defined by a rectilinear groove-cut therearound, and wherein the articulable rectilinearly shaped tab has a sloped first side; a second bore arranged through the gripping plate having an overlap with the rectilinear groove-cut at the first side of the articulable tab; and a threaded bolt adjustably received in the second bore, the threaded bolt having a head with a sloped sidewall for sliding engagement with the sloped first side of the articulable tab so as to provide a displaceable bias thereaginst during rotative advancement or retraction of the threaded bolt within the second bore, thereby effecting a change in the circularity of the wall of the tool receiving first bore; wherein the slope of the first side of the articulable tab is about 3 to 5 degrees; wherein the flexible finger extends about 180 degrees around the wall of the first bore; and wherein the second bore overlaps with the groove-cut around the articulable tab. The rectilinearly shaped tab and flexible finger are moved in a slight arcuate direction about the proximal end of the flexible finger, when the threaded bold is adjusted in the second bore.

BRIEF DESCRIPTIONS OF THE DRAWINGS

The objects and advantage of the present invention will become more apparent when viewed in conjunction with the following drawings, in which.

DETAILED DESCRIPTION OF THE INVENTION

Figure 1:
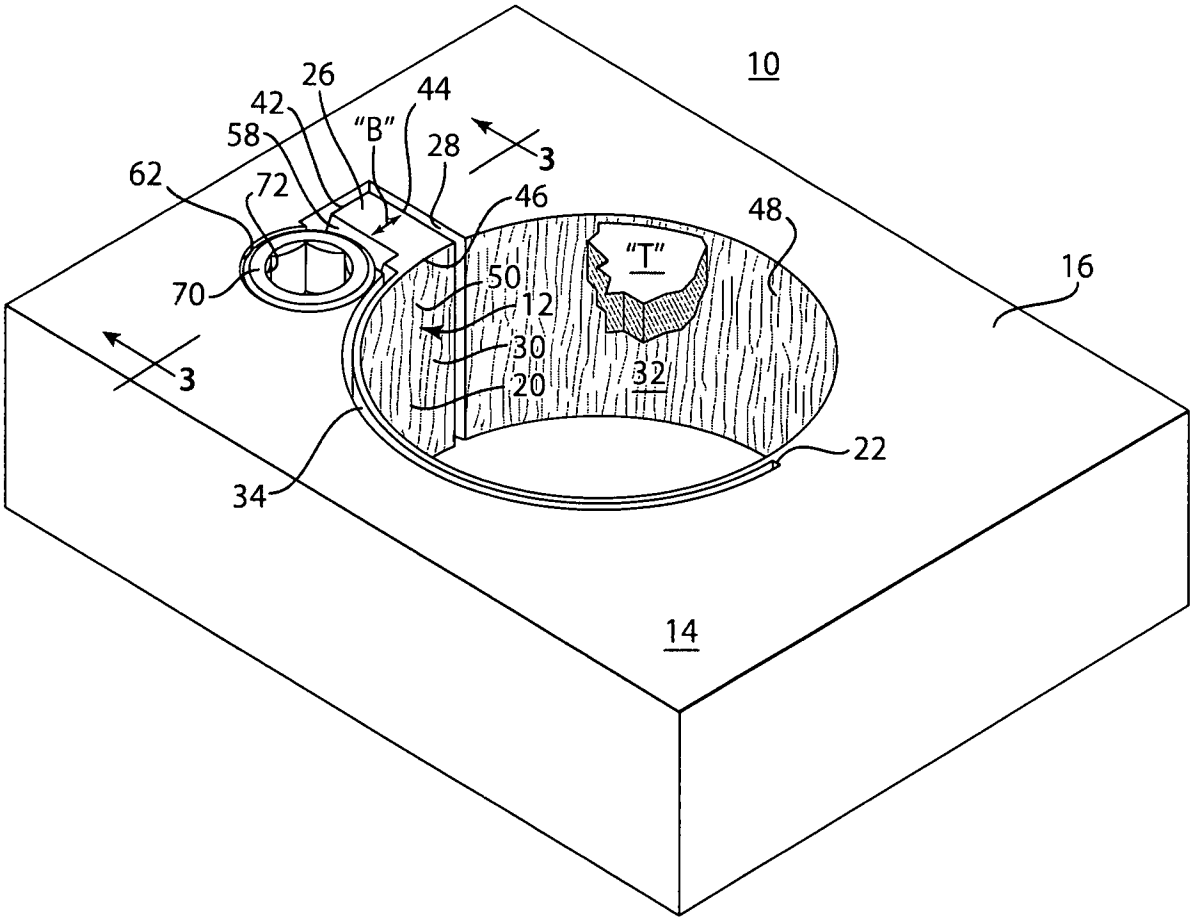
FIG. 1 is a perspective view of a portion of a gripping plate with a flexible finger mechanism arranged therein.
Figure 4:
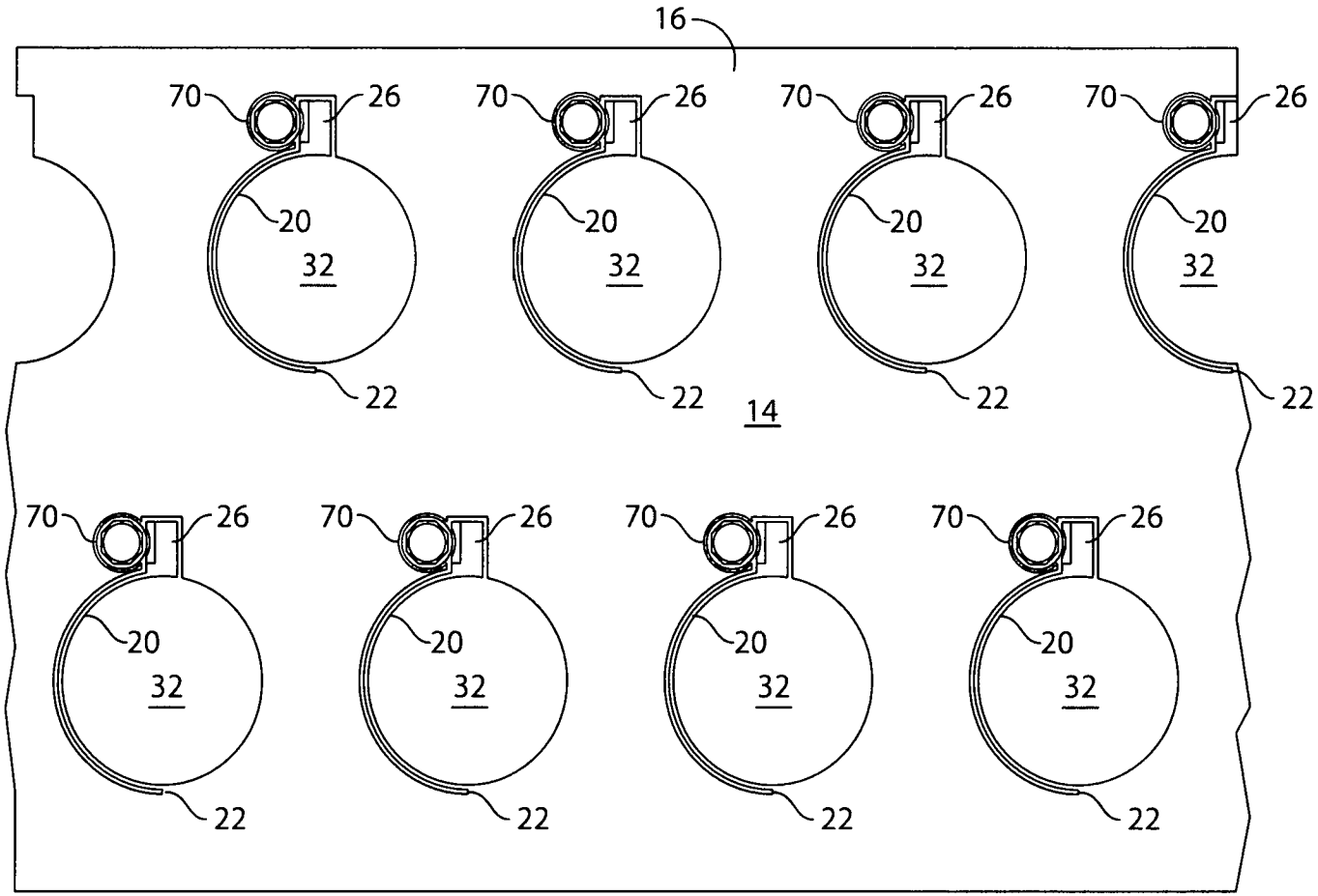
FIG. 4 is a plan view of a gripping plate with a plurality of rows of flexible finger mechanisms arranged thereacross.

Referring now to the drawings in detail, and particularly to FIG. 1, there is shown the present invention which comprises a gripping plate arrangement 10 which enables a flexible finger mechanism 12 to be arranged as a plurality thereof on a single gripping plate 14, (as shown in FIG. 4), and individually adjusted from a front face 16 thereof, only one flexible finger mechanism 12 being shown on the gripping plate 14, as represented in FIG. 1. Such a gripping plate arrangement 10 is utilized in a punch press apparatus as shown in U.S. Pat. No. 8,925,435, which is incorporated herein by reference in its entirety.

Figure 2:
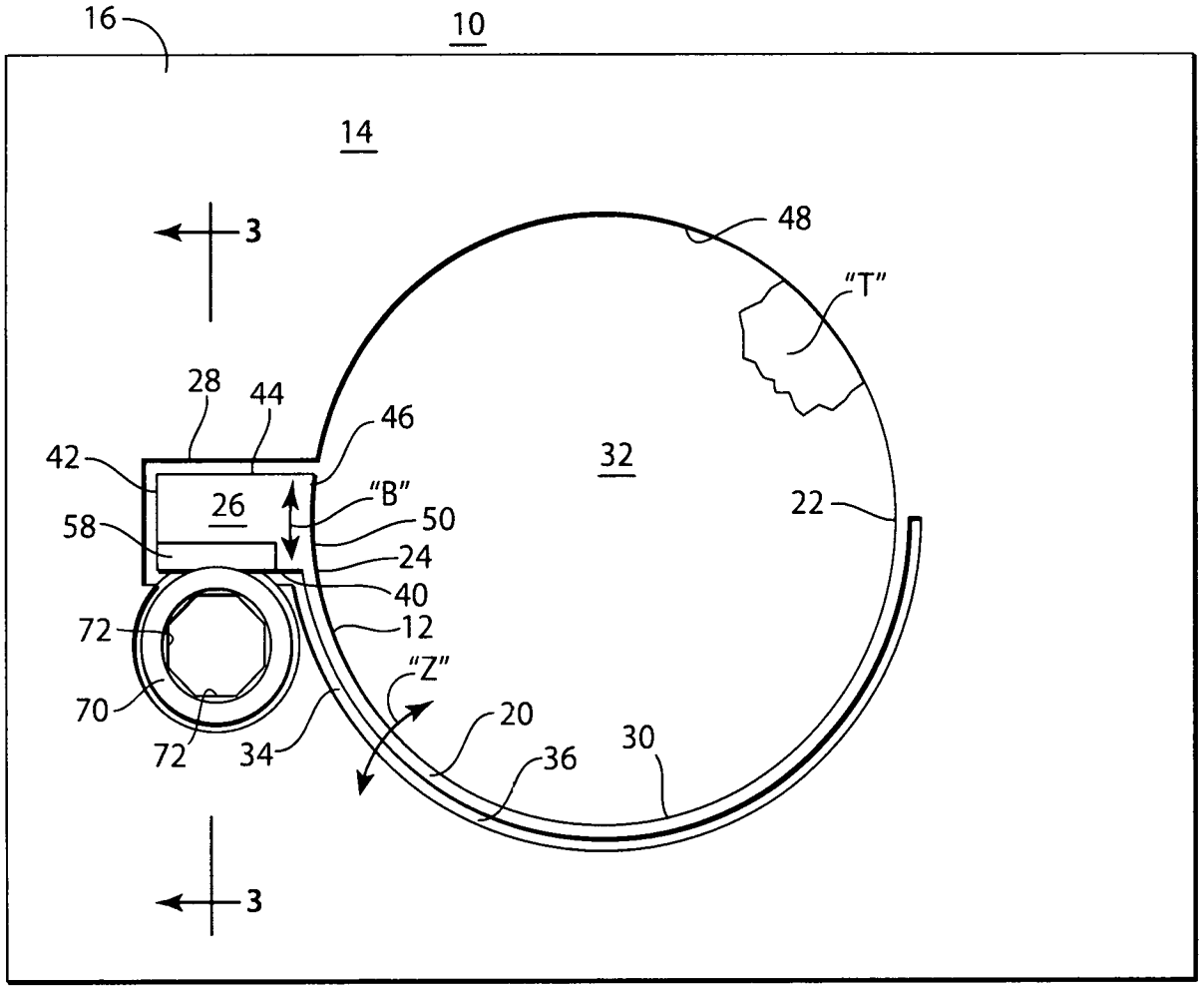
FIG. 2 is a plan view of the gripping plate and flexible finger mechanism shown in FIG. 1.

Each flexible finger mechanism 12 comprises an arcuately extending flexible ribbon-like finger 20 having a first end 22 unitarily connected to, and formed from the gripping plate 14 (aka holder plate or keeper plate), the flexible finger 20 having a second or distal end 24 having a generally rectilinear, articulable tab 26 thereon, as is evident from FIG. 2. The articulable tab 26 is biasedly held within the confines of a rectilinear channel or cutout groove-cut 28, discussed further hereinbelow. The flexible finger 20 has a curvilinear first or inner side 30 which defines about half the circumference of a circular, tool gripping first bore 32 extending through the gripping plate 14. The flexible finger 20 has a curvilinear second or outer side 34 made from and defined by an arcuate groove-cut 36 through the gripping plate 14. The arcuate, semi-annular, groove-cut 36 through the gripping plate 14 becomes a rectilinear groove-cut 28, mentioned hereinabove, at the distal end 24 of the flexible finger 20 to define the outer perimeter of the rectilinear, articulable tab 26. The rectilinear groove-cut 28 defines three linear sides 40, 42 and 44 of the articulable tab 26, as best shown in FIG. 2. The articulable tab 26 has a fourth or curvilinear side 46 facing inwardly to the first bore 32 and defines a contiguous further portion of the wall 48 of the circular first bore 32 through the gripping plate 12, as is shown in FIGS. 1 and 2. The wall 48 of the first bore 32 at the arcuate groove-cut 36 at the first or proximal end 22 of the finger 12 and a mid-point 50 at the curvilinear side 46 of the articulable tab are preferably about 180 degrees apart from one another around the perimeter of the wall 48 of the first bore 32, as may be seen in FIG. 2.

The generally rectilinear articulable tab 26 at the distal end 24 of the curvilinear finger 20 has its first side 40, its second side 42 and its third side 44 comprising the three linear sides thereof defined by the groove-cut 28 defining same. The first side 40 of the articulable tab 26 has a sloped surface 58 arranged at an angle "A" of about 3 to 5 degrees with respect to normal of the upper (front) face 16 and lower planar surface 60 of the gripping plate 14, as represented in FIG. 3.

Figure 3:
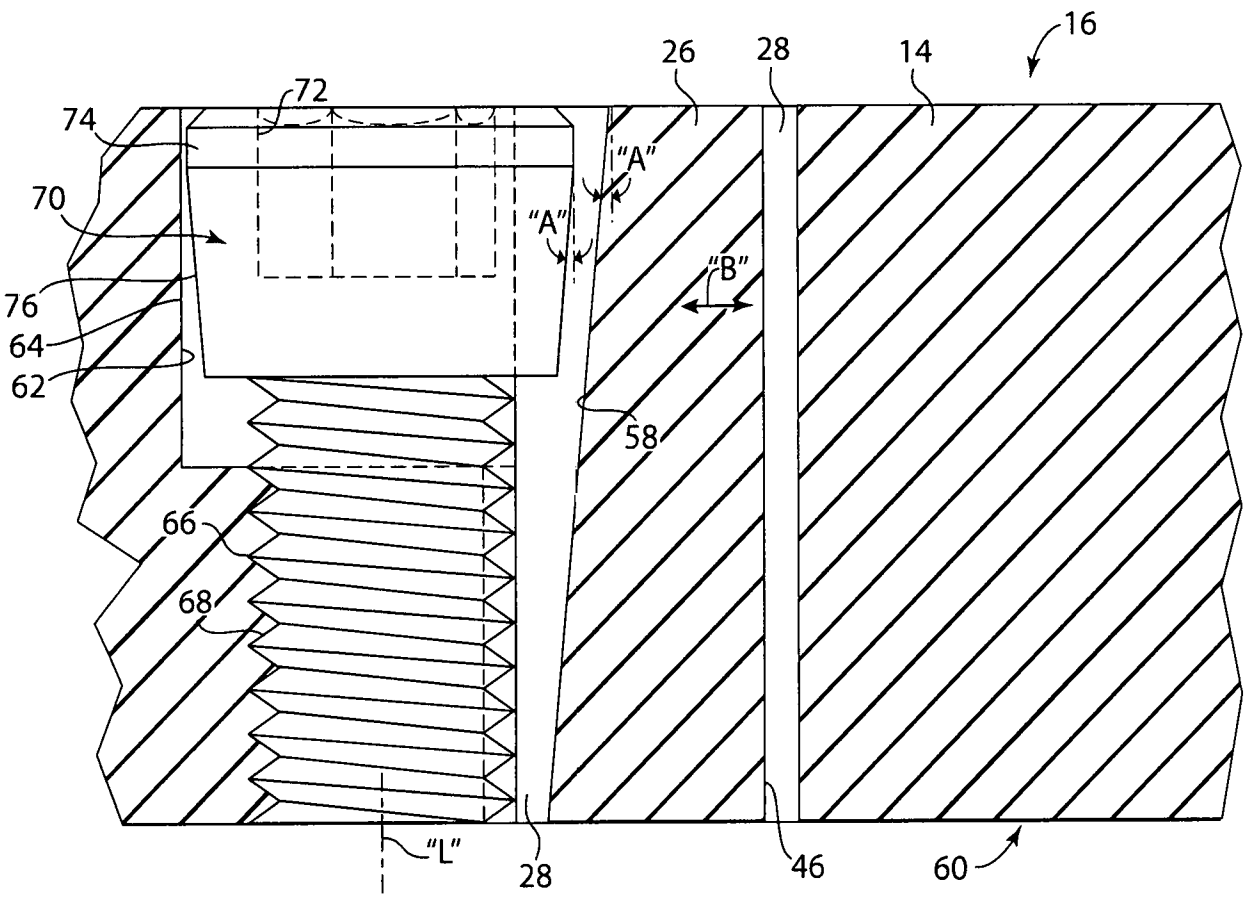
FIG. 3 is a sectional view taken along the lines 3-3 shown in both FIGS. 1 and 2.

A second bore 62 is disposed through the gripping plate 12 immediately adjacent the first side 40 of the articulable tab 26, as shown in FIGS. 1, 2, 3 and 4. The second bore 62 has an upper end 64 and a lower half or end 66. The lower half or lower end 66 of the second bore 62 is threaded 68 so as to enable receipt of a hand tool-adjustable threaded bolt or screw 70, as represented in FIG. 3.

A hand-tool-adjustable threaded bolt or screw 70 for use with the present invention preferably has an Allen Wrench type receiving opening 72 (or socket, or a slot) at its head 74 or upper end. The head 74 of a finger-adjusting bolt or screw 70 would have a head 74 with (smooth, conically shaped) tapered walls 76, having a taper angle "A" of about 3 to 5 degrees with respect to its longitudinal axis "L", corresponding to the slope of the first side 40, (shown best in FIG. 2), of the articulable tab 26 on the distal end 24 of the flexible finger 20, as shown in FIG. 3.

The upper half 64 of the second bore 62 is arranged to overlap with the rectilinear cut groove 28 at the first side 40 of the articulable tab 26, as is best seen in FIG. 3, so as to expose the tapered head 74 of a hand-tool-adjustable bolt or screw 70 into the cut groove 28 at the first side 40 of the articulable tab 26. Advancing a hand-tool-adjusting tapered head bolt or screw 70 into the threaded portion 68 in the lower half 66 of the second bore 62 in the gripping plate 14 brings the tapered walls 76 of the hand-tool-adjusting bolt or screw 70 into sliding (biasing or releasing) contact (in a very slight arcuate direction-slightly pivoting about the proximal first end point 22, as represented by the arrow "Z" in FIG. 2) towards or away (depending on the direction of rotation of the tapered headed bolt or screw 70) from the sloped first wall 58 of the articulable tab 26. Such sliding contact between the now longitudinally advancing or withdrawing of the (conically shaped) tapered side wall 80 of the head 74 of the hand-tool-adjusting bolt or screw 70 and the sloped first side wall 58 of the articulable tab 26, and biases that articulable tab 26 towards or away from the cut groove 28 on the third side 46 of the articulable tab 26, as represented by the double arrow "B" shown in FIGS. 1, 2 and 3, thus adjusting and/or correcting the placement of the fourth side 46 of the articulable tab 26 into proper tool "T" engaging circular shape of the first bore 32 through the gripping plate 14, enabling proper aligned gripping or release of a tool "T" therewithin.

The enablement of adjustment to the correctness of circularity of the first bore 32 from the top (front) side 16 of the gripping plate 14 enables a plurality of rows or columns of such flexible finger mechanisms 12 to be disposed within a single plate 14, as represented in FIG. 4, thus avoiding the requirement of making those adjustments from a side edge of the gripping plate, and overcoming the limiting of the number of such flexible finger mechanisms usable in a single gripping plate.

I claim:

1. A gripping plate assembly for use in a punch press, the gripping plate assembly comprising:

a planar gripping plate having an upper front side and a lower side;

a first bore extending through the gripping plate, for receiving a tool for use in a punch press, the first bore defining an inner wall;

a semi-annular groove-cut extending half way around the inner wall of the first bore to define an arcuate flexible finger having a proximal end unitary with the gripping plate, and the flexible finger with a distal end having an articulable rectilinearly shaped tab thereon, the articulable tab peripherally defined by a rectilinear groove-cut therearound, and wherein the articulable tab has a sloped first side;

a second bore arranged through the gripping plate having an overlap with the rectilinear groove-cut at the first side of the articulable tab; and a threaded bolt adjustably received in the second bore, the threaded bolt having a head with a sloped sidewall for sliding engagement with the sloped first side of the articulable tab so as to provide a displaceable bias thereaginst during rotative advancement or retraction of the threaded bolt within the second bore, thereby effecting a change in circularity of the wall of the tool receiving first bore.

2. The gripping plate assembly as recited in claim 1, wherein the slope of the first side of the articulable tab is about 3 to 5 degrees.

3. The gripping assembly as recited in claim 1, wherein the flexible finger extends about 180 degrees around the wall of the first bore.

4. The gripping assembly as recited in claim 1 wherein the second bore overlaps with the groove-cut around the articulable tab.

5. The gripping assembly as recited in claim 1, wherein the groove-cut has an inner side which defines an arcuate outer side of the flexible finger.

6. The gripping assembly as recited in claim 1, wherein the articulable tab is biasable against the groove-cut defining a third side.

7. The gripping assembly as recited in claim 1, wherein the articulable tab has a fourth side which is curvilinear and corresponds to the inner wall of the first bore.

8. A system for gripping and aligning a tool in a punch press utilizing a gripping plate, comprising:

arranging a gripping mechanism comprising a first tool-engaging circularity-adjustable bore through a front face of a gripping plate, the first tool-engaging bore having a side wall;

forming a groove-cut around a semi-circular portion of the side wall of the first bore to form an elongated, arcuately shaped flexible finger having a proximal end integral with the gripping plate, and a distal end with an articulable tab, the articulable tab being defined by a rectilinear groove-cut extending peripherally there-around;

arranging a second bore through the front face of the gripping plate, adjacent the first bore, the second bore being in overlapping placement with the groove-cut defining the rectilinear groove-cut which defines the periphery of the articulable tab, the second bore have a threaded lower half for receipt of a articulable tab adjustment threaded bolt;

arranging a sloped surface on a first side of the articulable tab;

placing a threaded bolt into the second bore;

placing a tool into the first bore, for alignment in a punch press; and turning the threaded bolt so as to engage the sloped surface on the articulable tab, biasing the articulable tab in a sideways direction to change circularity of the first bore holding the tool therein.

9. The system as recited in claim 8, wherein the threaded bolt has a head on its upper end, the head having a circumferential wall which is sloped to bias-ably correspond to the slope of the first side of the articulable tab.

10. The system as recited in claim 8, wherein the slope on the first side of the articulable tab is about 3 to 5 degrees from normal, with respect to the front face of the gripping plate.

11. The system as recited in claim 8, wherein the threaded bolt has an open tool engaging hole at its upper end for receipt of a turning tool via the front face.

12. The system as recited in claim 8, including arranging a plurality of gripping mechanisms into a gripping plate to enable a plurality of tools to be engaged by a single gripping plate.

13. A gripping plate assembly for use in a punch press, the gripping plate assembly comprising:

a planar gripping plate having an upper front side and a lower side;

a first bore extending through the gripping plate, for receiving a tool for use in a punch press, the first bore defining an inner wall;

a semi-annular groove-cut extending half way around the inner wall of the first bore to define an arcuate flexible finger having a proximal end unitary with the gripping plate, and the flexible finger with a distal end having an articulable rectilinearly shaped tab thereon, the articulable rectilinearly shaped tab peripherally defined by a rectilinear groove-cut therearound, and wherein the articulable rectilinearly shaped tab has a sloped first side;

a second bore arranged through the gripping plate having an overlap with the rectilinear groove-cut at the first side of the articulable tab; and a threaded bolt adjustably received in the second bore, the threaded bold having a head with a sloped sidewall for sliding engagement with the sloped first side of the articulable tab so as to provide a displaceable bias thereaginst during rotative advancement or retraction of the threaded bolt within the second bore, thereby effecting a change in the circularity of the wall of the tool receiving first bore; wherein the slope of the first side of the articulable tab is about 3 to 5 degrees; wherein the flexible finger extends about 180 degrees around the wall of the first bore; and wherein the second bore overlaps with the groove-cut around the articulable tab.

14. The gripping late assembly as recited in claim 13, wherein the rectilinearly shaped tab and flexible finger are moved in a slight arcuate direction about the proximal end of the flexible finger, when the threaded bold is adjusted in the second bore.

* * * * *